United States Patent [19]

Watkins, Jr.

[11] 4,069,516

[45] Jan. 24, 1978

[54] BREATHING FACE MASK

[75] Inventor: Dudley W. Watkins, Jr., Williamsville, N.Y.

[73] Assignee: A-T-O Inc., Willoughby, Ohio

[21] Appl. No.: 707,221

[22] Filed: July 21, 1976

[51] Int. Cl.[2] ..... A62B 18/00

[52] U.S. Cl. ..... 2/428; 128/141 R

[58] Field of Search ..... 2/428, 429, 430, 9, 2/6; 128/146.7, 141 R, 142

[56] References Cited

U.S. PATENT DOCUMENTS

| | | | |
|---|---|---|---|
| 2,881,444 | 4/1959 | Fresh et al. | 2/428 X |
| 3,362,403 | 1/1968 | Fleming et al. | 2/6 X |
| 3,545,436 | 12/1970 | Holloway | 128/146.7 X |

FOREIGN PATENT DOCUMENTS

| | | | |
|---|---|---|---|
| 920,668 | 4/1947 | France | 2/428 |
| 496,358 | 9/1952 | Italy | 2/428 |

*Primary Examiner*—Werner H. Schroeder
*Assistant Examiner*—Peter Nerbun
*Attorney, Agent, or Firm*—Christel & Bean

[57] ABSTRACT

A resiliently flexible sealing element conformable to the face of a wearer is supported by and spaced from a mask body by a resiliently flexible web, the sealing element and web extending perimetrically around the open side of the mask body and the hinge web having a bead extending along the opposite sides and across the top of the mask for controlled buckling of the web in a manner mechanically loading the face engaging sealing element.

6 Claims, 12 Drawing Figures

BREATHING FACE MASK

BACKGROUND OF THE INVENTION

This invention relates particularly to breathing face masks which seal against the face of a user and exclude the ambient environment from those portions of the face which are confined by the mask.

It is important that a face mask properly fit the face of the wearer. The need for a good seal is self-evident. However, comfort in the fit of the mask to the face also is a significant factor because if the mask is not comfortable to wear it will bother and distract the user.

Generally, face masks are not custom made. Instead, they are made in only a very limited number of shapes and sizes, intended for use with a wide variety of facial shapes and sizes. The wide range in shape and size of the human face makes it difficult to provide a mask which will comfortably fit a variety of users, particularly with masks designed to provide wide angle vision.

U.S. Pat. No. 3,545,436, assigned to the Assignee of this application, discloses a useful face mask seal arrangement in which a floating seal is suspended from a relatively rigid mask body in a manner to be conformable in sealing relation to the face of a user independently of the mask body. As the mask is positioned against the face a connecting hinge web resiliently yields and urges the floating seal against the face.

In some situations, for example when the mask has a relatively flat upper edge curvature to comfortably fit beneath a fireman's helmet, it is desireable to reinforce the sealing action provided by such connecting hinge web as it resiliently yields and buckles.

SUMMARY OF THE INVENTION

The primary object of this invention is to provide a face mask seal of the foregoing type wherein the buckling of the connecting hinge web is controlled in a manner to mechanically load the face engaging part and thereby reinforce the sealing action.

Another object of this invention is to provide the foregoing in a mask having a full vision face piece and a comfortable, gas tight fit against the face.

Still another object of this invention is to accomplish the foregoing in a mask adapted to fit a wide variety of facial shapes and sizes, and in a construction which is practical to manufacture.

The foregoing and other novel features of the instant invention will become apparent from the ensuing detailed description of an illustrative embodiment, reference being made to the various drawing figures illustrating such embodiment.

DESCRIPTION OF THE DRAWING FIGURES

Figure 1:
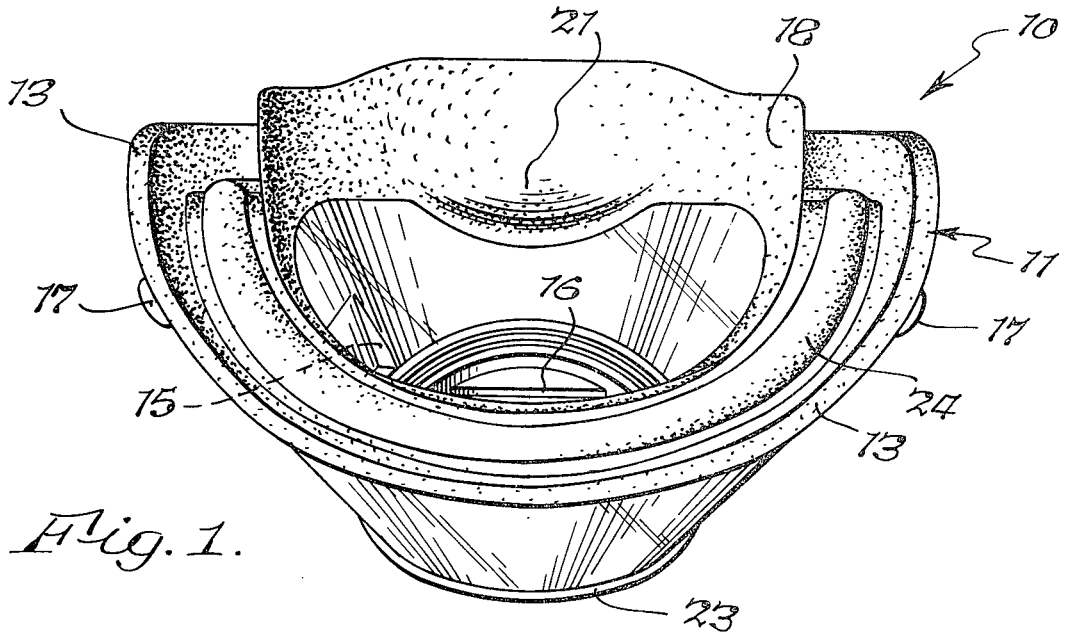
FIG. 1 is a top plan view of a face mask, showing a seal made in accord with the instant invention.
Figure 2:
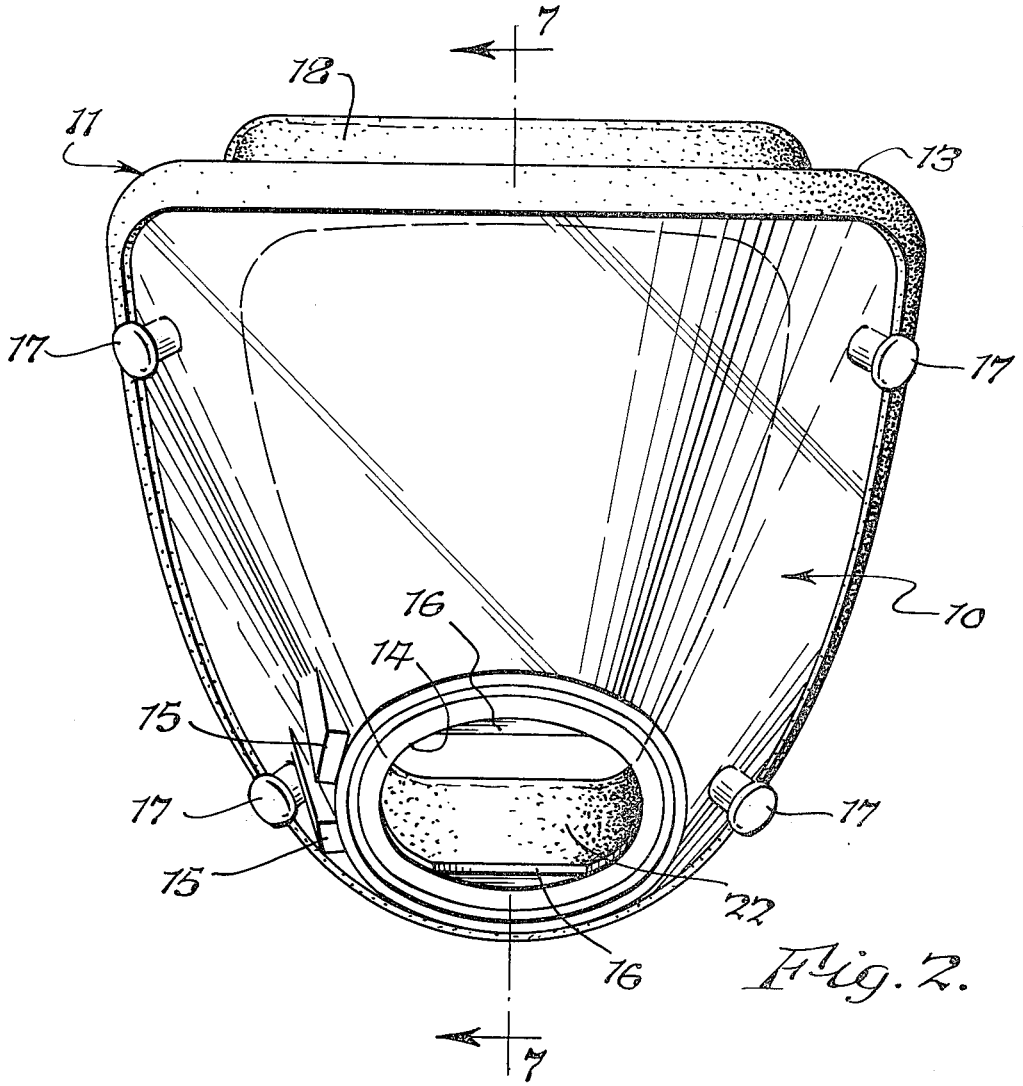
FIG. 2 is a front elevational view thereof.
Figure 3:
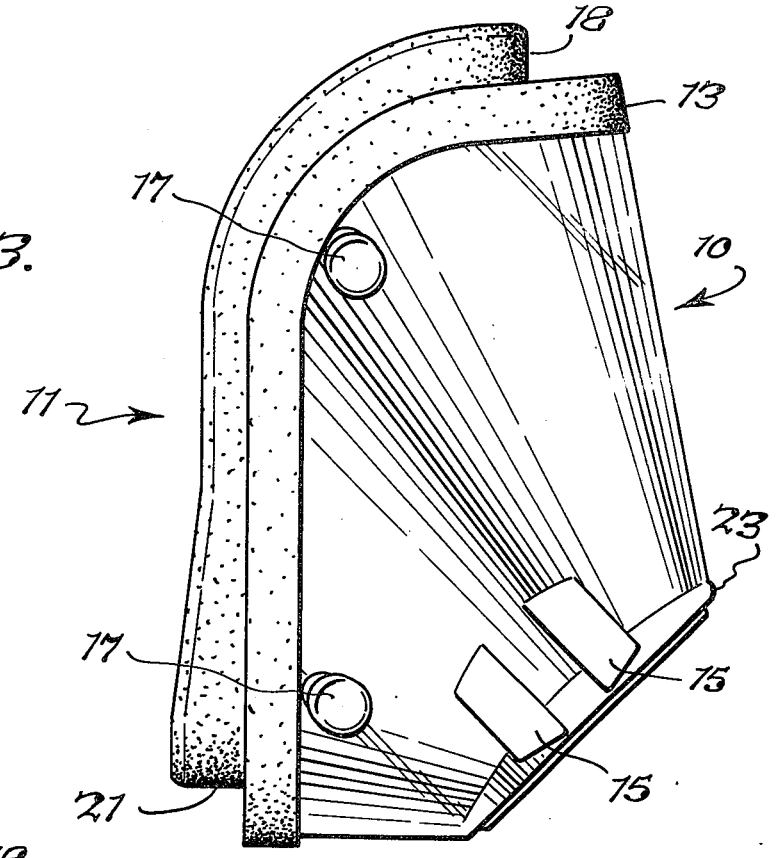
FIG. 3 is a side elevational view thereof.
Figure 4:
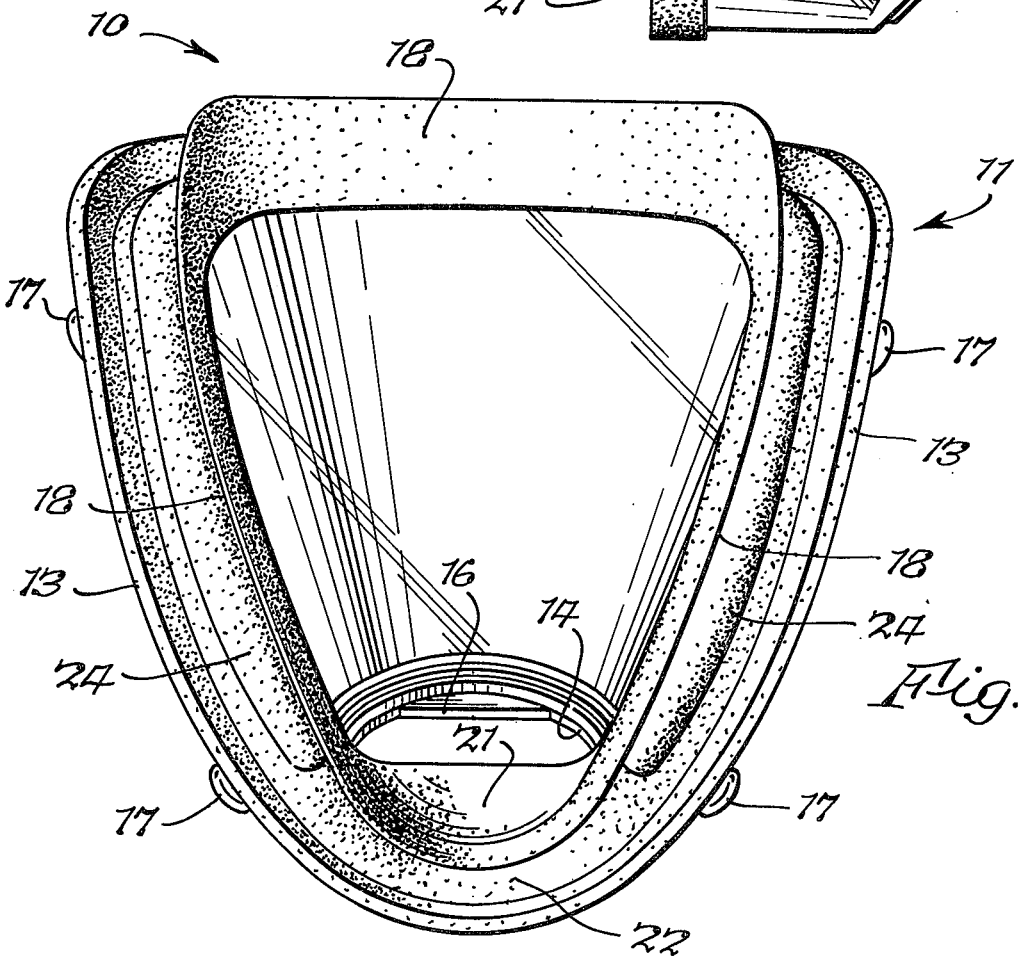
FIG. 4 is a rear elevational view thereof.
Figure 5:
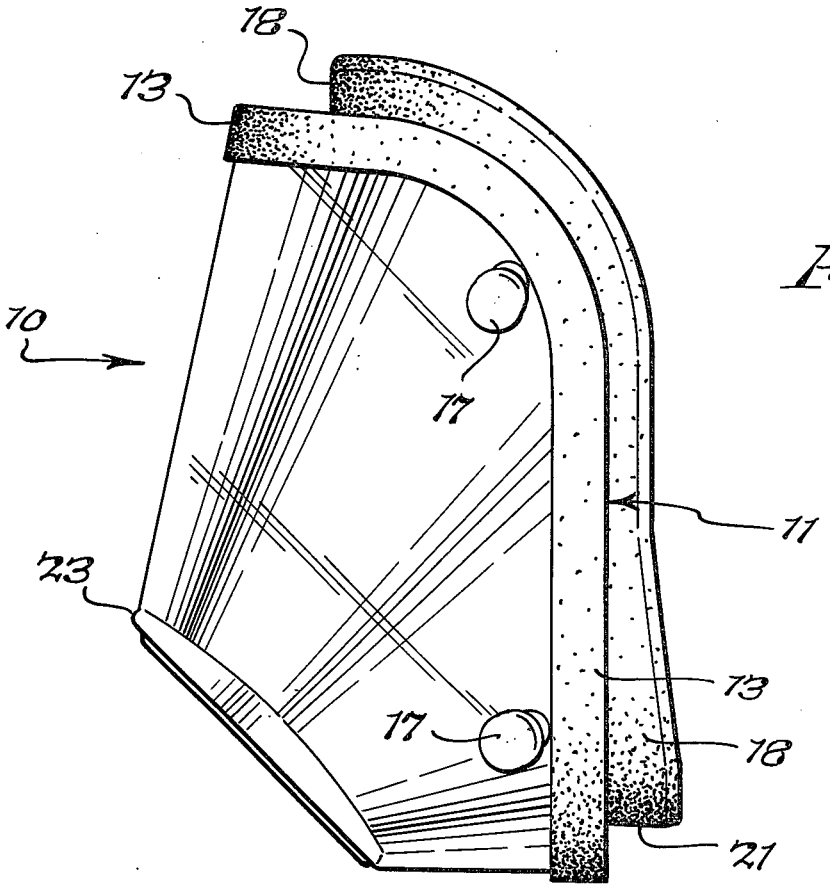
FIG. 5 is an opposite side elevational view thereof.
Figure 6:
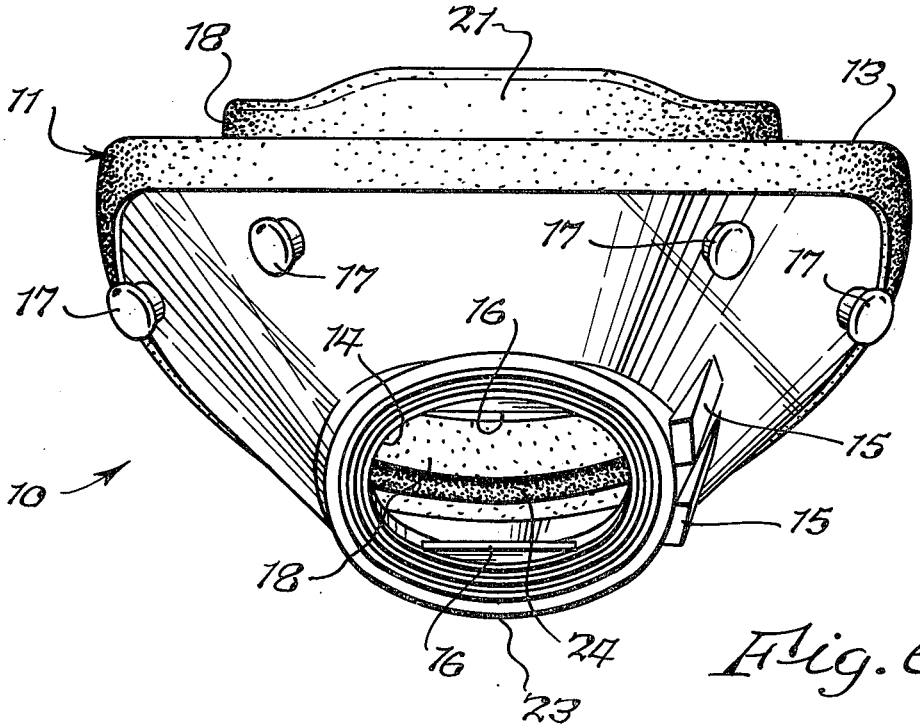
FIG. 6 is a bottom plan view thereof.
Figure 7:
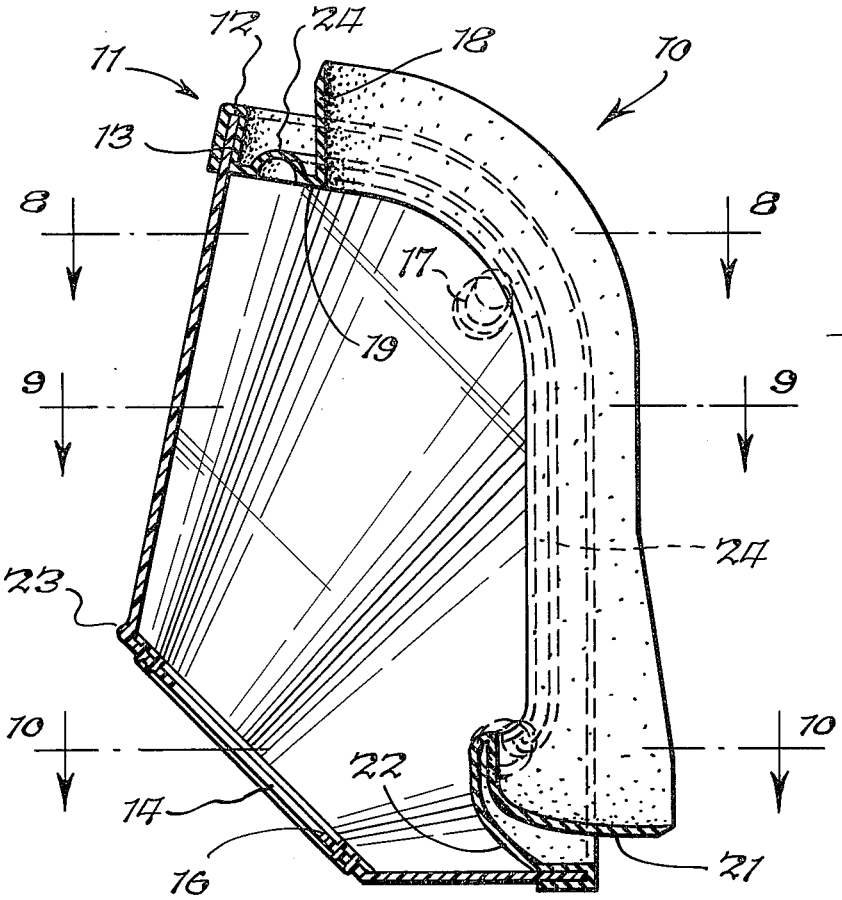
FIG. 7 is a vertical sectional view taken about on line 7—7 of FIG. 2.
Figure 8:
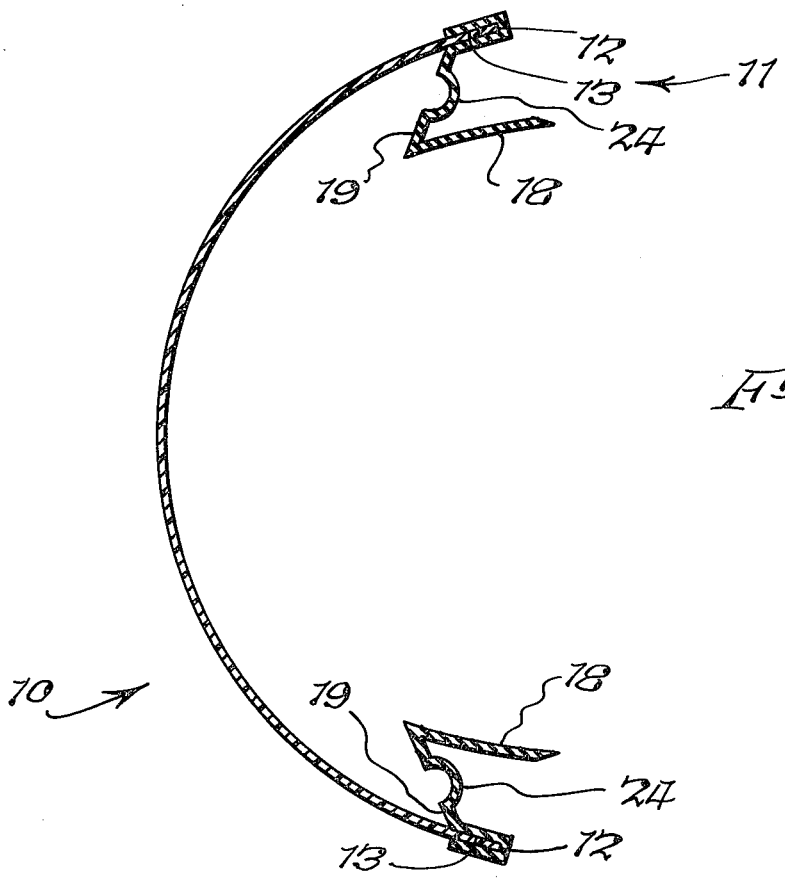
Figure 9:
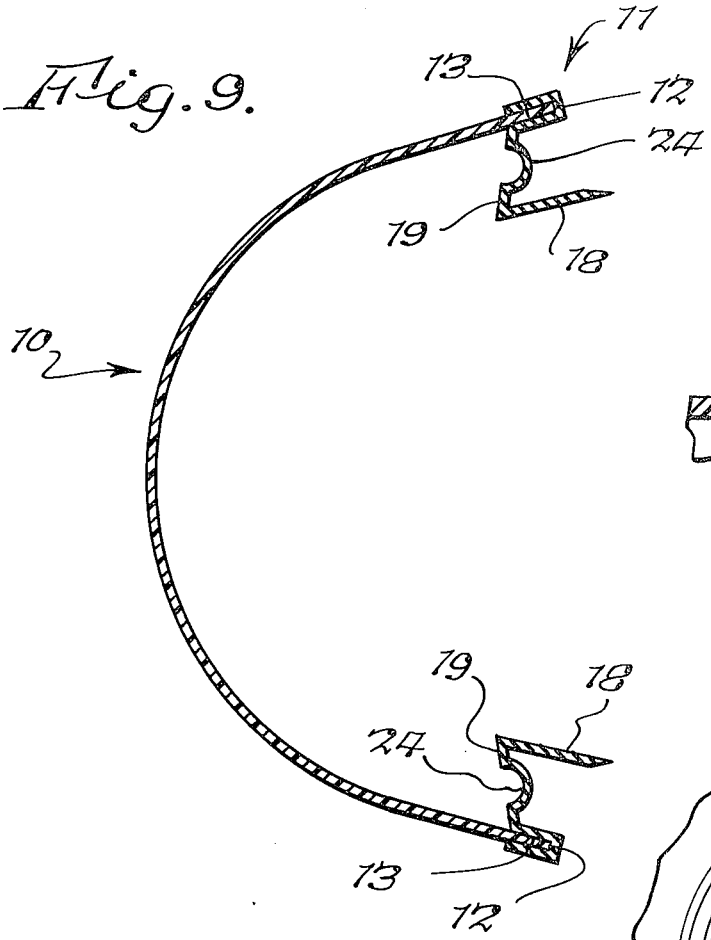
Figure 11:
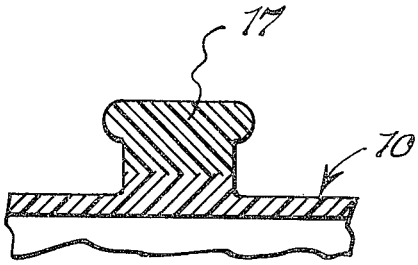
Figure 10:
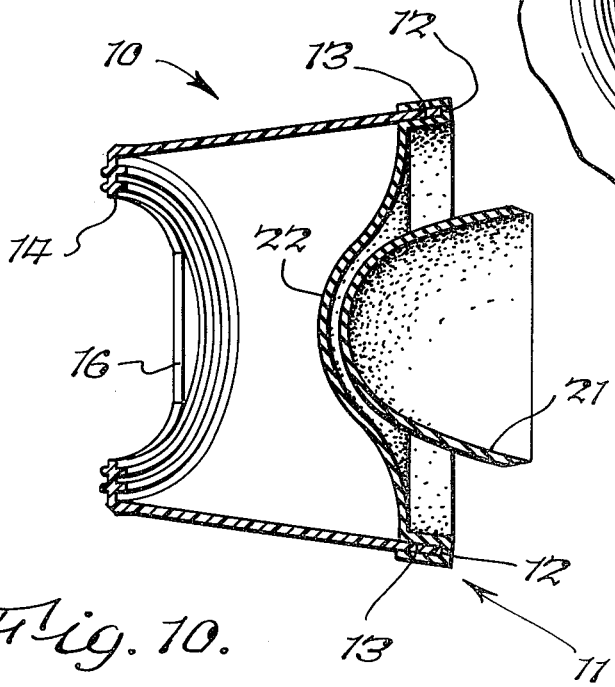

FIGS. 8, 9 and 10 are horizontal sectional views taken about on lines 8—8, 9—9 and 10—10, respectively, of FIG. 7;

FIG. 11 is a fragmentary sectional detailed view, on an enlarged scale; and

Figure 12:
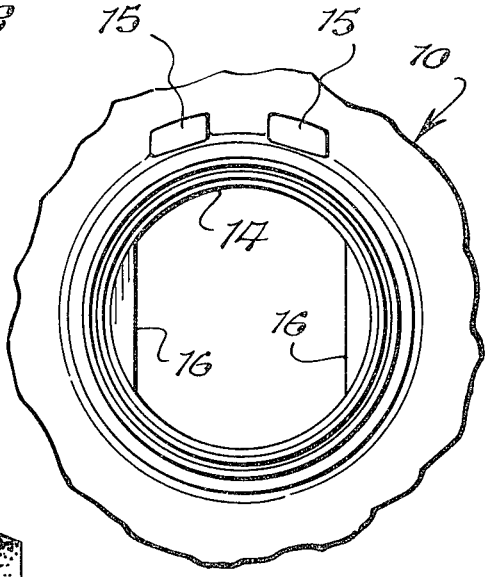

FIG. 12 is another fragmentary detailed view.

DESCRIPTION OF THE ILLUSTRATED EMBODIMENT

Referring now in detail to the accompanying drawings, there is shown a face mask comprising a body generally designated 10 and a seal generally designated 11. Mask body 10 has a perimetrical edge 12 defining an opening for receiving portions of the face of a user, the edge 12 being received in a sealing channel 13 formed as part of seal 11, thereby sealing the mask body to the mask seal either by adhesive bonding therebetween or otherwise.

Mask body 10 is formed entirely of a relatively rigid, shaped sustaining, transparent plastic material fully enclosing the facial features of the user, including the eyes, nose and mouth within the confines of edge 12, thereby providing a mask offering wide angle vision. An opening 14 is provided in the lower portion of the mask body 10, and the body is formed adjacent the opening with elements such as shown at 15 and 16 for receiving in releasable interlocking relation therewith a demand regulator and associated air hoses, valves and filters for other related equipment, all of which can be of conventional design and are not shown. Projections 17 are provided on mask body 10, adjacent the upper and lower opposite side portions thereof, for connection with a fastening arrangement, not shown, adapted to secure the face mask in place against the face of the user.

Seal 11 is of one-piece construction, formed of a resiliently flexible material such as natural or synthetic rubber of a type suitable for use in the intended environment, and generally conforms to the perimetrical outline of the edge 12. In addition to the channel portion 13 which receives the edge 12 of the mask body, the seal has a sealing flange 18 adapted to engage against the face of the user, and a connecting web 19 hingedly joining the flange 18 to the channel securing section 13. The three integrally formed sections of the seal, 13, 18 and 19, are perimetrical in that they extend completely around the open side of the mask body, the face engaging flange being formed adjacent its lower end in a cup-shape to provide a chin receiving and engaging section 21, the connecting hinge web 19 being cooperatively formed to support the same as shown at 22.

It will be appreciated that the mask body can assume other shapes, and still be used with the seal 11, the particular mask body shape shown in the drawings being desireable from the view ofproviding full angle vision in a shape of generally variably conic construction whereby the section 13 of seal 11 in conjunction with rib the 23 and associated peripheral portions around opening 14 support the intervening mask body portions off a flat supporting surface which the mask might be placed.

When the mask is fitted in place against the face of the user, the face engaging flange 18 will flex and resiliently yield to conform to the face, and the connecting hinge web section 19 also will resiliently yield to accommodate variations in spacing between the edge 12 of the mask body and the face of the user. In the process of yielding, the connecting web section 19 will buckle and it is a particular feature of this invention that such buckling is controlled in a manner mechanically loading the face engaging flange 18 to reinforce the sealing action. This is accomplished by forming the connecting web 19 with a convolution or bead 24 which extends across the upper portion of the mask continuously downwardly along the opposite side portions, to a point adjacent the bottom, chin receiving section which, by reason of its construction, does not require such reinforcement. Bead 24 is generally semicircular in transverse section, and projects outwardly relative to the mask body, as shown in FIGS. 7, 8 and 9, between the channel section 13 and the flange 18. More specificlly, web 19 extends from the inner edge of the channel section 12 to the inner edge of the sealing flange 18 which projects outwardly therefrom relative to the face receiving cavity defined by the mask. The bead 24 also projects outwardly, in the direction of flange 18 whereby upon movement of flange 18 a predetermined distance toward the mask body 10, flange 18 will abut the bead 24 which then provides a mechanical loading, in addition to the resilient restoring force of the connecting hinged web section 19, to reinforce the sealing action of flange 18 against the face of the wearer.

In the absence of bead 24, buckling of the connecting web 19 might occur inwardly into the mask cavity, away from physical engagement with the flange 18, whereas with the construction of this invention, such deformation of the connecting web will bring the beaded portion of the web into engagement with the flange to enhance the sealing action.

Thus, it is seen that my invention accomplishes its intended objects, in a very simple, practical and efficient manner. While only one embodiment has been illustrated and described, it will be appreciated that this is done by way of example only and not by way of limitation.

I claim:

1. A face seal comprising, in combination with a body having an open side adapted to fit about facial portions of a user, said body defining a facial portion receiving cavity and having a marginal edge portion around said open side thereof, sealing means adapted to form a seal between said body and the face of a user thereof, said sealing means comprising a resiliently flexible perimetrical sealing element conformable in sealing relation with a face, and a resiliently flexible perimetrical connecting web joining said sealing element to said body in spaced relation thereto, said sealing element normally being suspended from said body by said web in inwardly spaced relation to said marginal edge portion therearound whereby said face mask is conformable in sealing relation to the face of a user independently of said body, said web being formed with a bead extending thereabout adjacent to said marginal edge portion, said bead projecting out of the plane of said web in a manner to mechanically load said sealing element upon predetermined buckling of said web.

2. A face seal according to claim 1 wherein said web extends generally in a transverse manner relative to said sealing element and said marginal edge portion of said body and is hingedly joined to said sealing element and said body adjacent respective opposite perimetrical edge portions thereof.

3. A face seal according to claim 2 wherein said bead projects out of the plane of said web in a direction toward the perimetrical edge portion of said sealing element not hingedly joined to said web.

4. A face seal according to claim 2 wherein said mask body is relatively rigid, shape-sustaining and transparent throughout.

5. A face seal as set forth in claim 2 wherein said sealing element includes a portion extending inwardly of said facial portion receiving cavity to form a socket for receiving the chin of a user.

6. A face seal as set forth in claim 2 wherein said web and said sealing element are of integral one piece construction.

* * * * *